United States Patent [19]

Franke

[11] 4,206,357

[45] Jun. 3, 1980

[54] X-RAY DIAGNOSTIC GENERATOR

[75] Inventor: Kurt Franke, Erlangen, Fed. Rep. of Germany

[73] Assignee: Siemens Aktiengesellschaft, Berlin & Munich, Fed. Rep. of Germany

[21] Appl. No.: 962,076

[22] Filed: Nov. 20, 1978

[30] Foreign Application Priority Data

Jan. 20, 1978 [DE] Fed. Rep. of Germany ..... 2802451

[51] Int. Cl.[2] ..... H05G 1/32

[52] U.S. Cl. ..... 250/408; 250/421

[58] Field of Search ..... 250/408, 409, 421

[56] References Cited

U.S. PATENT DOCUMENTS

| | | | |
|---|---|---|---|
| 3,333,104 | 6/1967 | Bougle | 250/409 |
| 3,406,286 | 10/1968 | Bross | 250/421 |
| 3,636,355 | 1/1972 | James et al. | 250/421 |

FOREIGN PATENT DOCUMENTS

| | | |
|---|---|---|
| 1005204 | 9/1957 | Fed. Rep. of Germany . |
| 2037767 | 2/1972 | Fed. Rep. of Germany . |
| 1077742 | 8/1967 | United Kingdom . |

*Primary Examiner*—Alfred E. Smith
*Assistant Examiner*—T. N. Grigsby
*Attorney, Agent, or Firm*—Hill, Van Santen, Steadman, Chiara & Simpson

[57] ABSTRACT

In an illustrative embodiment, a high voltage transformer has a high voltage rectifier and an x-ray tube connected thereto, in which a switch and control tube lies in the x-ray tube circuit, a control installation supplying to a control grid of the switch and control tube, a voltage determining the voltage of the x-ray tube. A semiconductor switching arrangement with ignition characteristic is in series with the switch and control tube and has a control stage which delivers an ignition signal for the engagement of the x-ray tube.

2 Claims, 1 Drawing Figure

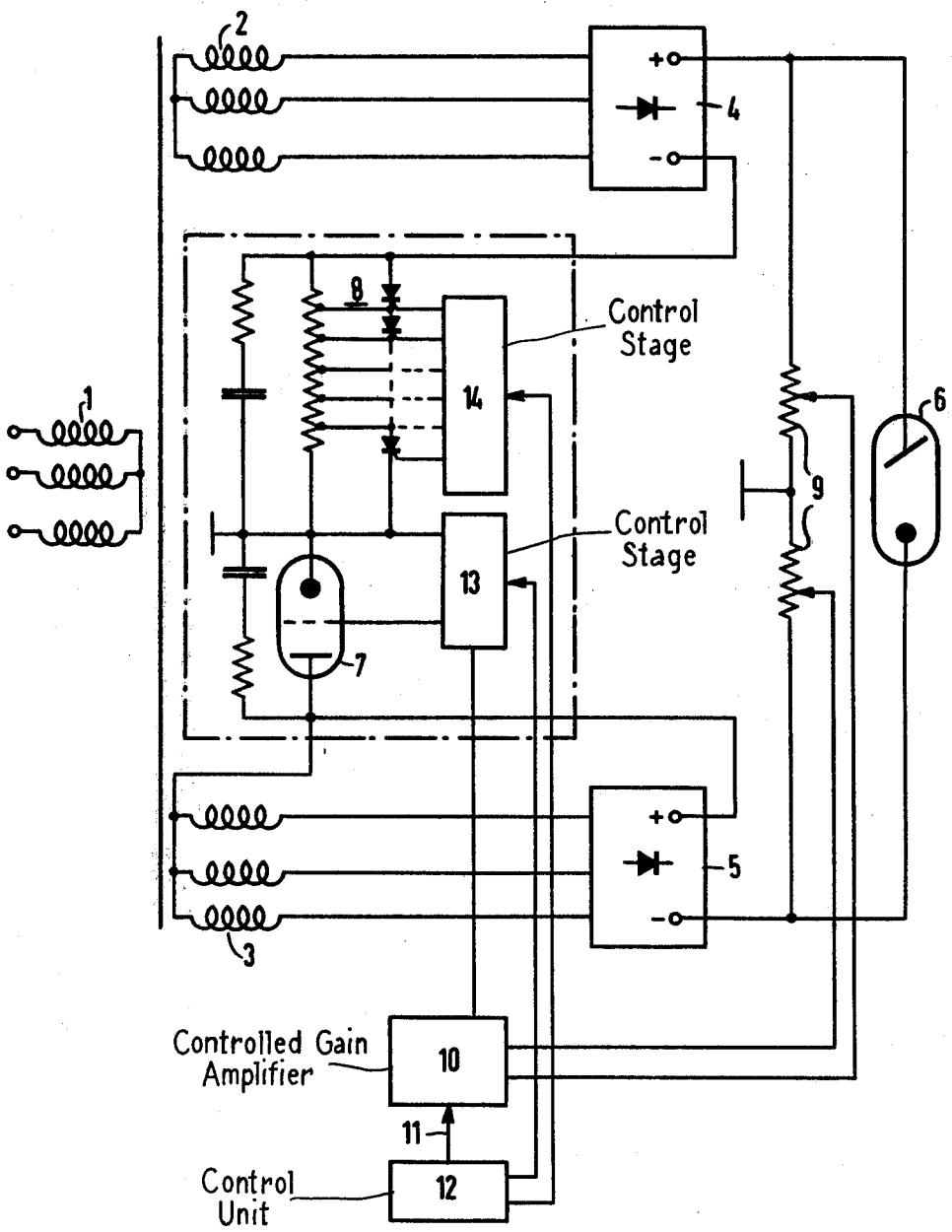
2
4
8
Control Stage
14
1
6
9
Control Stage
13
7
5
3
Controlled Gain Amplifier
10
11
Control Unit
12

X-RAY DIAGNOSTIC GENERATOR

BACKGROUND OF THE INVENTION

The invention relates to an x-ray diagnostic generator comprising a high voltage transformer, a high voltage rectifier and an x-ray tube connected thereto, in which a switch and control tube lies in the x-ray tube circuit and is connected to a control arrangement which supplies a control voltage to the grid of the switch and control tube for determining the x-ray tube voltage.

An x-ray diagnostic generator of this type is described in the German Pat. No. 1,005,204. In this x-ray diagnostic generator, the switch and control tube is developed as a triode and lies, with its cathode-anode segment, in the connection between two sections of the high voltage rectifier. In order to switch off the x-ray tube, a negative potential is applied to the control grid of the switch and control tube, so that this blocks. Thereby, the full open circuit voltage lies across the cathode-anode segment, so that the switch and control tube must be dimensioned accordingly.

To effect a reduction of the voltage load across the switch and control tube, it is known through the German Offenlegungsschrift No. 2,037,767 to provide a grid-controlled x-ray tube and to switch the x-ray tube on and off via the control grid. It is also already known (British Specification No. 1,077,742) to interpose two switch and control tubes in series with the x-ray tube. In this case, only half of the open-circuit voltage lies across one switch and control tube in the moment of switching off. A switch and control tube is a relatively expensive component part, so that the utilization of two such component parts greatly increases the cost of the x-ray diagnostic apparatus.

SUMMARY OF THE INVENTION

The object of the invention is to design an x-ray diagnostic generator of the type initially cited in such manner that, with the use of a single switch and control tube, only half of the open-circuit voltage is present across this tube upon shutting off, so that it need only be dimensioned in respect to its electric strength for this half-open-circuit voltage; further the engaging and disengaging of the x-ray tube is not effected by means of a control grid in the x-ray tube—thus no special x-ray tube is used—but rather by means of switch and control tube.

This object is inventively achieved in that a semiconductor switching arrangement with ignition characteristic lies in series with the switch and control tube, which arrangement is controlled by a control device that delivers ignition signals for the engagement of the x-ray tube. In the inventive x-ray diagnostic generator, the regulation of the x-ray tube voltage ensues via the switch and control tube, namely by adjusting the resistance of the switch and control tube via the grid potential to correspond to the x-ray tube voltage required in any particular case. For disengaging, the switch and control tube is suddenly blocked by means of negative grid potential. Thereby, the semiconductor switching arrangement with ignition characteristic is also extinguished, so that the open-circuit voltage divides itself between this semiconductor switching arrangement and the switch and control tube.

The invention is more closely explained in the following on the basis of a sample embodiment illustrated in the accompanying sheet of drawings; and other objects, features and advantages will be apparent from this detailed disclosure and from the appended claims.

BRIEF DESCRIPTION OF THE DRAWING

The single FIGURE shows an electric circuit diagram of an embodiment of the present invention.

DETAILED DESCRIPTION

In the drawing, a three-phase high voltage transformer comprising three primary windings 1 and two groups 2 and 3 of three secondary windings each is illustrated. The secondary winding groups 2 and 3 feed two high voltage rectifiers 4 and 5 which lie in series with one another and are connected to an x-ray tube 6. The series connection comprising a switch and control tube 7 and a thyristor series 8 lies in the connection line between the negative pole of the high voltage rectifier 4 and the positive pole of the high voltage rectifier 5.

For the adjustment of the high voltage at the x-ray tube 6, a voltage divider 9 is provided, at which a voltage corresponding to the actual value of the x-ray tube voltage is tapped and supplied to a controlled-gain amplifier 10. A setpoint value signal for the x-ray tube voltage delivered from a control unit 12 is supplied to the setpoint value input 11 of the controlled-gain amplifier 10. Via control stages 13 and 14, the control unit 12 influences the control electrodes of the switch and control tube 7 as well as the thyristors of the thyristor series 8.

For engaging the x-ray tube 6, ignition potential is supplied to the control electrodes of the thyristors of the thyristor series 8. Further, the control grid of the switch and control tube 7 is connected to a potential which opens the switch and control tube 7. During operation, this potential is adjusted via the amplifier 10 in such a manner that the desired x-ray tube voltage lies at the x-ray tube 6. For disengaging the x-ray tube 6 for the termination of an x-ray exposure, the control stage 13 is influenced via the control unit 12—which can contain, for example, a time switch or a mAs relay—in such manner that it suddenly applies a negative potential to the control grid of the switch and control tube 7 that blocks this tube. Since the ignition potential has disappeared from the control electrodes of the thyristors of the thyristor series 8, the x-ray tube 6 is disengaged and in so doing approximately half of the open-circuit voltage of the high voltage transformer 1, 2, 3 lies respectively at the thyristor series 8 and at the switch and control tube 7. The number of thyristors of the thyristor series 8 is calculated in such a manner that, at the moment of disengagement, a voltage that lies below the highest allowable value lies at each of the thyristors.

By way of example, the setpoint value at 11 may be supplied by a manually adjusted potentiometer. Control unit 12 may also include a conventional exposure timer which in response to a manual switch closure activates an electronic analog switch of control stage 13, so that any error voltage from controlled gain differential amplifier 10 controls the conductivity of control tube 7 (via the electronic switch) in such a way as to maintain the actual voltage value tapped at voltage divider 9 at the setpoint value introduced at 11. The gain of amplifier 10 may be established in conjunction with the manual selection of the setpoint level for proper responsiveness and stability of the control loop. The signal from control unit 12 to control stage 13 maintains the electronic switch of component 13 in the conductive state for the duration of the exposure cycle and then cuts off tube 7 to terminate the exposure.

The exposure timer of unit 12 also emits a turn-on pulse to control stage 14, causing the application of an ignition pulse to the gate of each thyristor while an anode voltage is present across each thyristor of polarity to allow initiation of conduction. Holding current for maintaining conduction of the thyristor series 8 is provided by the simultaneous turn-on of control tube 7.

It will be apparent that many modifications and variations may be effected without departing from the scope of the novel concepts and teachings of the present invention.

I claim as my invention:

1. An x-ray diagnostic generator comprising a high voltage transformer, a high voltage rectifier and an x-ray tube connected thereto, in which a switch and control tube lies in the x-ray tube circuit, a control installation for connecting a control grid of the switch and control tube to a voltage that determines the voltage of the x-ray tube, characterized in that a semiconductor switching arrangement (8) with ignition characteristic lies in series with the switch and control tube (7), and is responsive to an ignition signal for controlling the engagement of the x-ray tube (6).

2. An x-ray diagnostic generator according to claim 1, characterized in that the semiconductor switching arrangement (8) consists of the serial connection of a plurality of thyristors to whose ignition electrodes the ignition signal is supplied in parallel.

* * * * *